US005443436A

United States Patent [19]

Kawakami et al.

[11] Patent Number: 5,443,436

[45] Date of Patent: Aug. 22, 1995

[54] AUTOMATIC EXCHANGING DEVICE OF CROSS BAR OF TRANSFER FEEDER AND CONTROL SYSTEM THEREFOR

[75] Inventors: Hideaki Kawakami; Satoru Enomae, both of Ishikawa, Japan

[73] Assignee: Kabushiki Kaisha Komatsu Seisakusho, Tokyo, Japan

[21] Appl. No.: 117,060

[22] PCT Filed: Mar. 13, 1992

[86] PCT No.: PCT/JP92/00310

§ 371 Date: Sep. 14, 1993

§ 102(e) Date: Sep. 14, 1993

[87] PCT Pub. No.: WO92/16320

PCT Pub. Date: Jan. 10, 1992

[30] Foreign Application Priority Data

Mar. 15, 1991 [JP] Japan ..... 3-022407 U
Mar. 15, 1991 [JP] Japan ..... 3-074274

[51] Int. Cl.[6] ..... B21J 13/08; B23Q 3/155

[52] U.S. Cl. ..... 483/9; 72/405; 483/29

[58] Field of Search ..... 483/28, 29, 8, 9; 72/405, 446, 448

[56] References Cited

U.S. PATENT DOCUMENTS 5,097,695 3/1992 Brzezniak ..... 72/405
5,140,839 8/1992 Bruns ..... 72/405
5,248,288 9/1993 Kamiya et al. ..... 483/28
5,337,594 8/1994 Petterson et al. ..... 72/446

FOREIGN PATENT DOCUMENTS 62-61742 3/1987 Japan .
63-170037 11/1988 Japan .

*Primary Examiner*—Z. R. Bilinsky
*Attorney, Agent, or Firm*—Finnegan, Henderson, Farabow, Garrett & Dunner

[57] ABSTRACT

The present invention is aimed to provide an automatic exchanging device of a cross bar of a transfer feeder and a control system therefor, which makes it possible to perform automatic exchanging of the cross bar. The cross bar automatic exchanging device of a transfer feeder comprises a cross bar exchanging robot (7) for exchanging cross bars (8) removed from a press body (1) with cross bars (8) to be used for the next time via a moving bolster (10), together with die (11) to be exchanged, and a cross bar storage rack (9) for storing necessary number of cross bars (8) for press processes to automatically perform all operations in that the cross bars (8) removed from the press body are taken out by the cross bar exchanging robot (7) and stored in the cross bar storage rack (9), and the cross bars (8) to be used in the next operation are taken out from the storage rack (9) and set on the cross bar receptacle base (12). Also, a control system for the cross bar automatic exchanging device includes a die discrimination device (47), a cross bar exchanging robot control device (48), a cross bar storage position storage device (49), a cross bar discrimination device (50) and a vacant storage position memory device (52) in the cross bar storage rack (9) so that the die and the cross bar adapted thereto can be discriminated and accurately and efficiently taken in and out.

16 Claims, 9 Drawing Sheets

AUTOMATIC EXCHANGING DEVICE OF CROSS BAR OF TRANSFER FEEDER AND CONTROL SYSTEM THEREFOR

FIELD OF THE INVENTION

The present invention relates to an automatic cross bar exchanging device for a transfer feeder, and a control system therefor.

BACKGROUND OF THE INVENTION

Conventionally, a transfer feeder employing a vacuum transporting system includes a plurality of cross bars transversely arranged between a pair of transfer feeders which are arranged in parallel with respect to a workplace transporting direction. For each of these cross bars, a work drawing means, such as a vacuum cup, is attached for drawing the workpiece.

The size of the above-mentioned workpiece drawing means is different depending upon the workpiece to be transported. Therefore, in the prior art devices, the cross bar must be removed from a press machine upon changing of the dies to provide cross bars having the proper workpiece drawing means mounted on them. This exchange is done external to the press prior to pressing. Further, the cross bars must be removed in order to exchange the workpiece drawing means.

However, the conventional exchanging operation has been performed manually by a worker and can take a long period of time and thus be inefficient. Furthermore, it is possible to damage the apparatus by interference with the die due to error in mounting or adjustment.

SUMMARY OF THE INVENTION

In view of the above-mentioned circumstances, the present invention has been used to improve the above-mentioned defects. Therefore, it is an object of the present invention to provide an automatic exchanging device for a transfer feeder cross bar, and a control system therefor, which makes it possible to perform automatic exchanging of the cross bar.

In order to accomplish the above-mentioned object, a cross bar automatic exchanging device of a transfer feeder, according to the first aspect of the present invention, comprises:

- a cross bar exchanging robot for exchanging cross bars removed from a press body with cross bars to be used for the next time via a moving bolster, together with a die to be exchanged; and
- a cross bar storage rack for storing necessary number of cross bars for press processes.

Also, in order to accomplish the above-mentioned object, a control system for a cross bar automatic exchanging device, in accordance with the second aspect of the invention, in which cross bars removed from a press body via a moving bolster together with a die to be exchanged are stored in a cross bar storage rack by a cross bar exchanging robot, and subsequently cross bars adapted to a die to be used in the next operation are set on the moving bolster by the cross bar exchanging robot, comprising:

- a die discrimination device for discriminating die identification indication provided on a plurality of dies and selecting a respective one of the dies to be used in the next operation;
- a cross bar discrimination device for discriminating cross bars adapted to the die to be used in the next operation among a plurality of cross bars respectively provided identification indications;
- a cross bar exchanging robot control device for controlling the cross bar exchanging robot for taking out the discriminated cross bars from the cross bar storage rack;
- a memory device for storing storage positions for respective of a plurality of cross bars stored in the cross bar storage rack; and
- a memory device for storing vacant storage positions in the cross bar storage rack.

With the cross bar exchanging device according to the present invention, the cross bars removed from the press body via the moving bolster together with the used die are taken out by the cross bar exchanging robot and stored in the cross bar storage rack, and the cross bars to be used in the next operation are taken from the cross bar storage rack and set on the moving bolster. Therefore, the cross bar exchanging operation can be performed automatically.

Since the exchanging of the cross bars can be efficiently performed in a short time, a shortening of the entire exchanging time is possible, as is an improvement of productivity. Also, since an error in mounting or adjustment will never occur, a damaging of the die can be prevented.

Further, with the control system for the cross bar automatic exchanging device, the used die removed from the transfer press via the moving bolster is identified the cross bars removed are carried by the cross bar exchanging robot to be stored in vacant storage positions in the cross bar storage rack, and the cross bars taken out from the cross bar storage rack are set on the cross bar receptacle base by means of the robot. Thus, since the die and the cross bars are exchanged after identification, improper attempts to mate cross bars to improper dies can be successfully avoided thereby preventing the dies from being damaged. Furthermore, since the vacant positions in the cross bar storage rack are preliminarily stored, the cross bar exchanging robot can be operated so as to travel a minimum distance during storing operation. As a result of this, the exchanging operation for a plurality of cross bars can be made efficient.

The objects, aspects and advantages of the present invention will become-apparent to those skilled in the art from the preferred embodiment consistent with the principle of the invention as described and illustrated on the accompanying drawings.

DETAILED DESCRIPTION OF THE PREFERRED EMBODIMENT

The preferred embodiment of the present invention will be discussed hereinafter in detail with reference to the accompanying drawings.

At first, a cross bar automatic exchanging device of the present invention will be discussed in terms of the embodiment illustrated in FIGS. 1 to 8.

Figure 1:
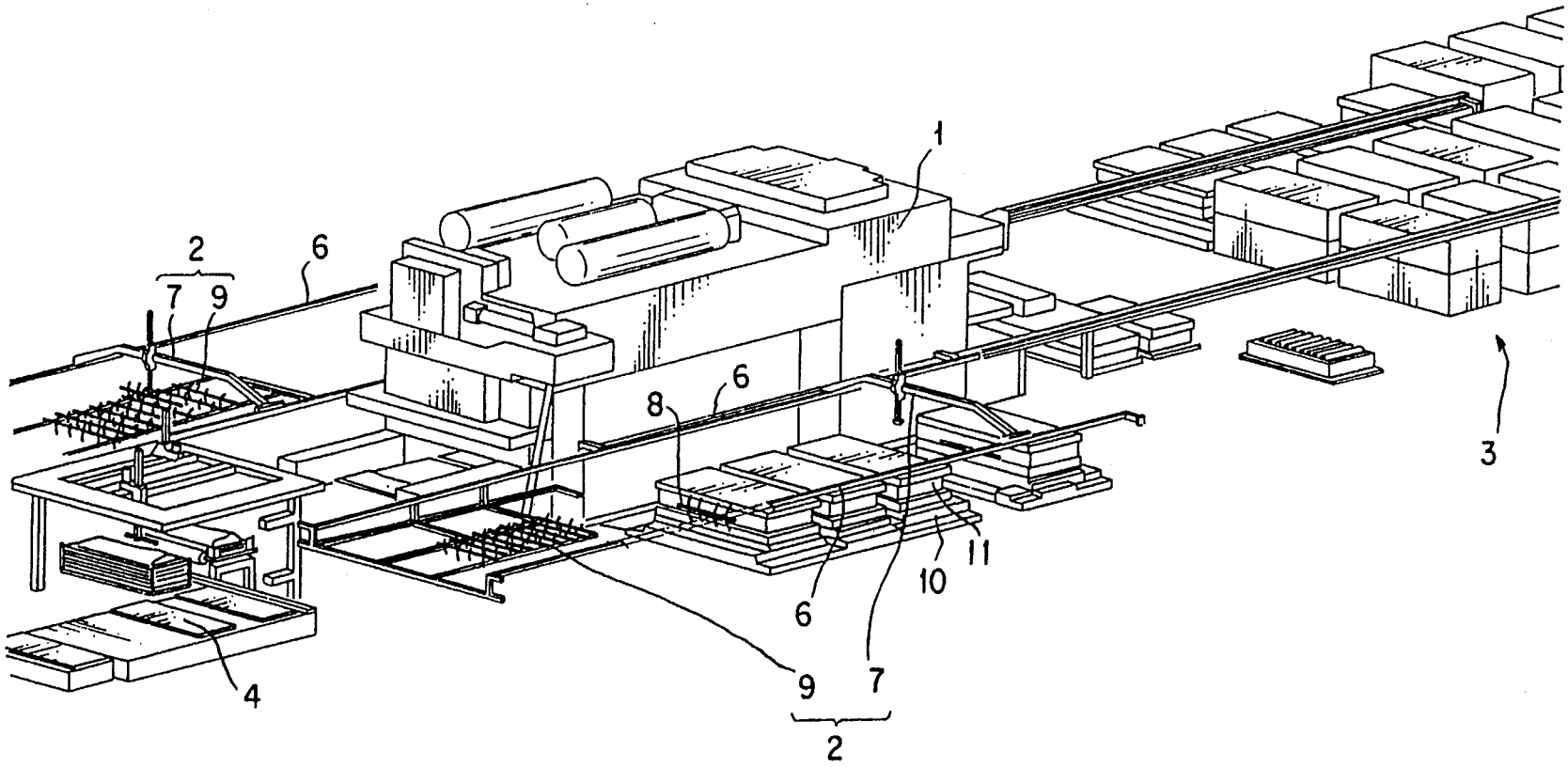
FIG. 1 is a perspective view of a general overview of a transfer press machine employing a cross bar automatic exchanging device as one embodiment of the present invention.
Figure 2:
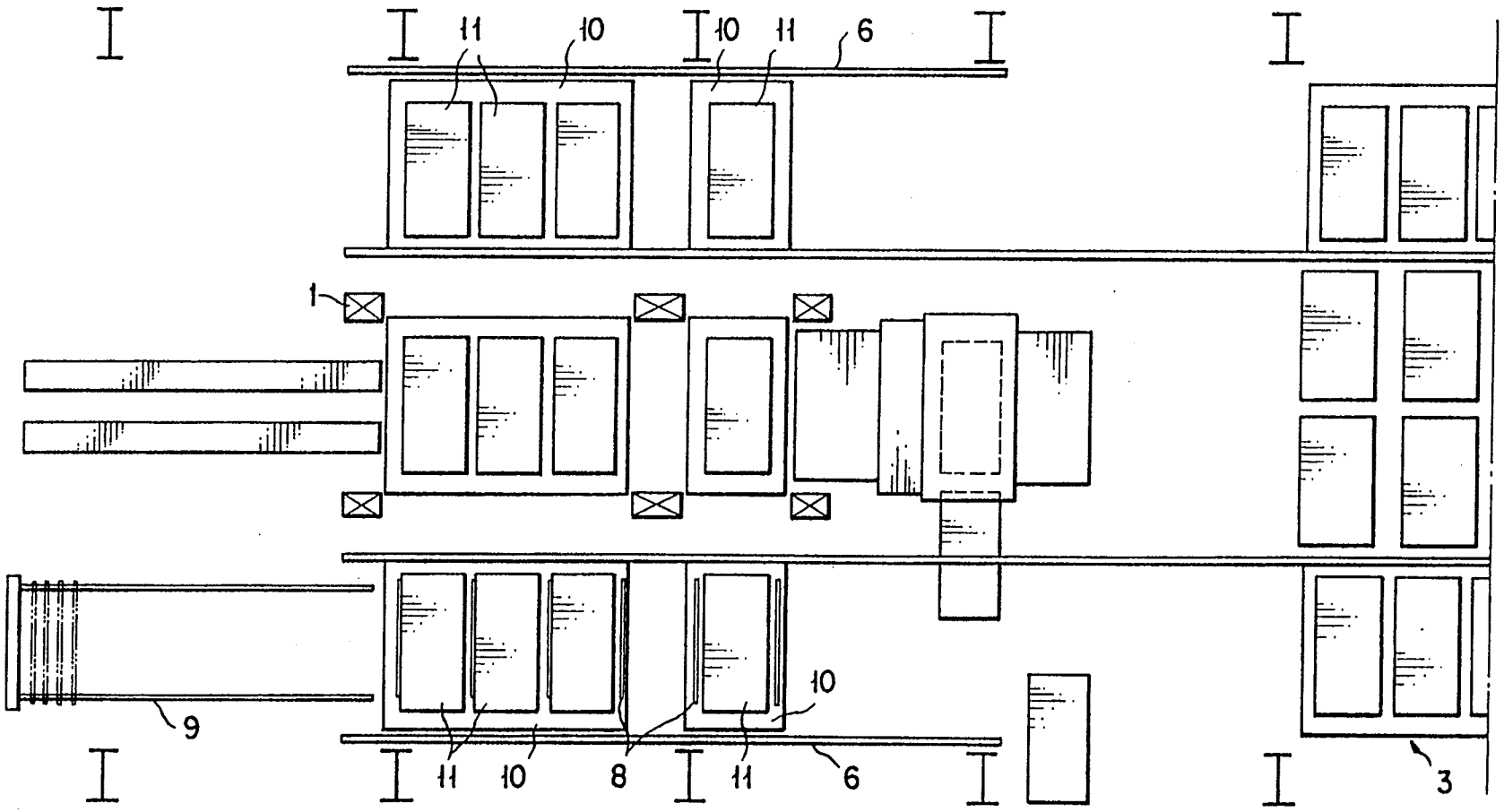
FIG. 2 is a fragmentary plan view of the transfer press shown in FIG. 1.
Figure 3A:
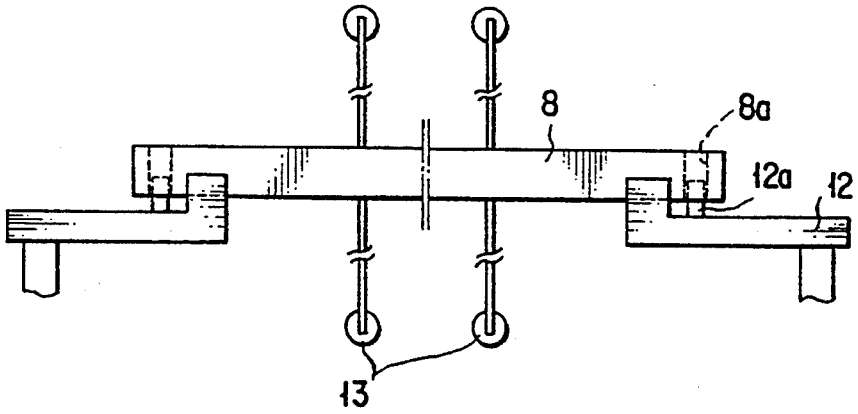
FIG. 3A is a front elevation of a cross member receptacle base.
Figure 4:
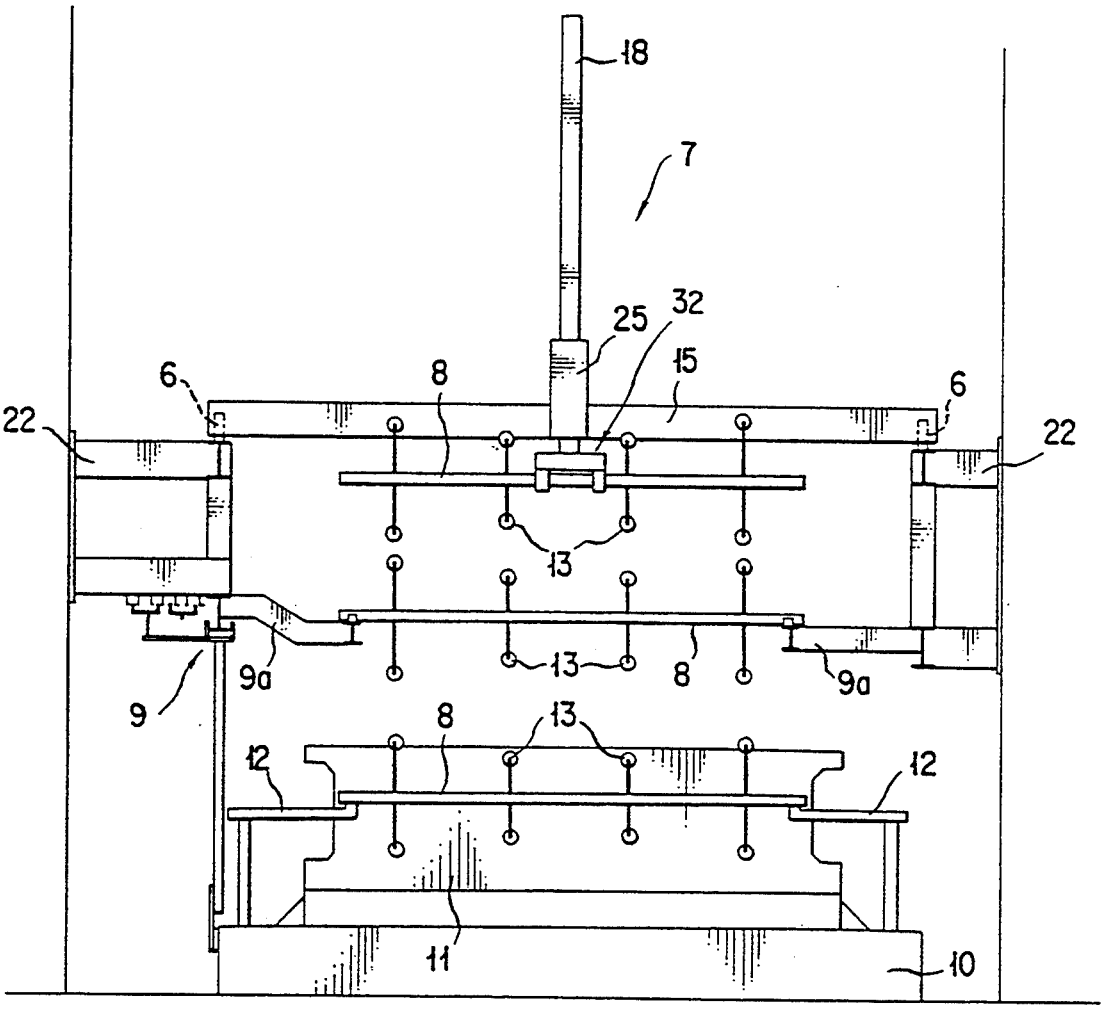
FIGS. 4, 5 and 6 are respectively a fragmentary front elevation, a fragmentary side elevation and a fragmentary plan view of the cross bar automatic exchanging device.
Figure 5:
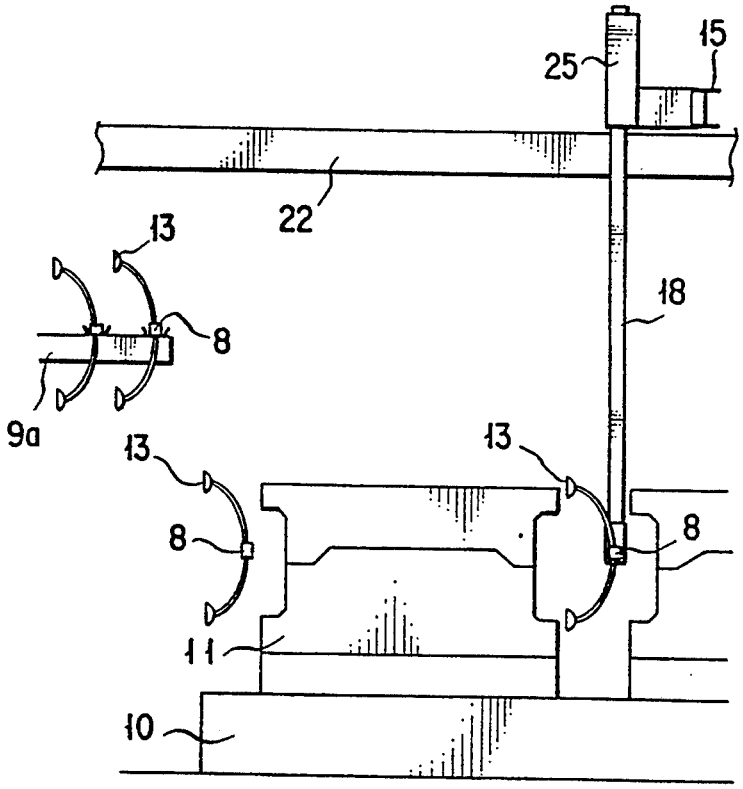
Figure 6:
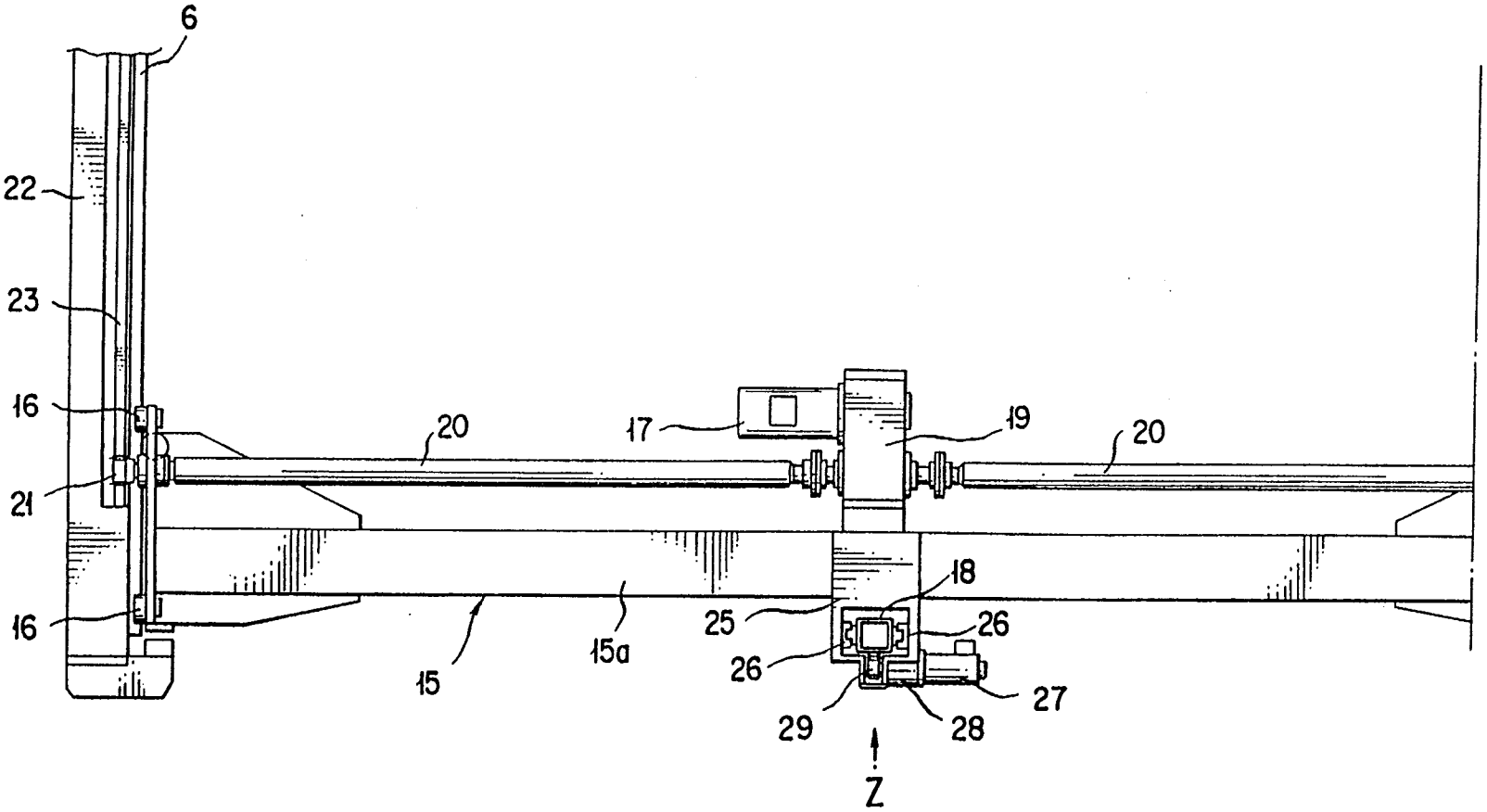
Figure 7:
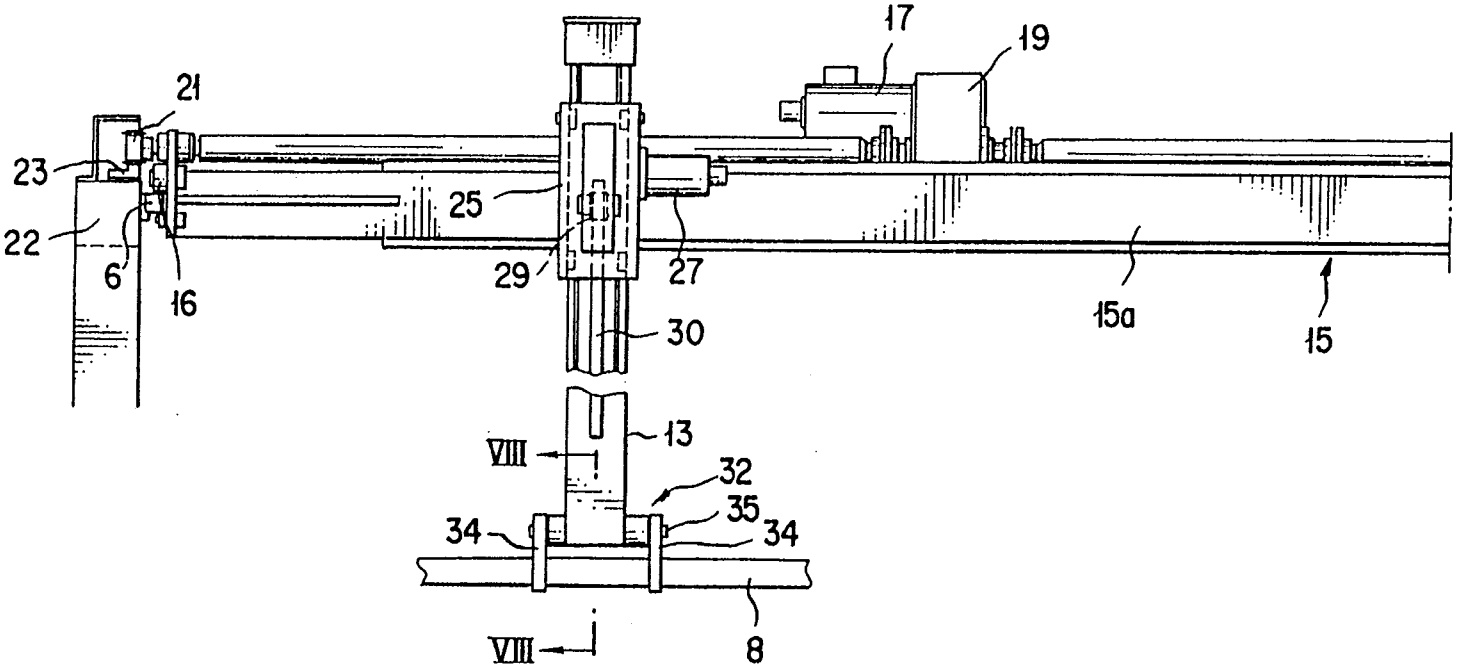
FIG. 7 is an illustration of the cross bar exchanging device as viewed in the direction of an arrow Z in FIG. 6.

FIG. 1 is a perspective of an overview of a transfer press and various facilities provided periphery thereof. FIG. 2 is a plan view of the same. FIG. 3A is a front elevation of a cross bar receptacle base. FIG. 38 is a front elevation of a cross bar storage rack. FIGS. 4 to 6 show the cross bar automatic exchanging device.

In these figures, 1 denotes a press body, 2 denotes a cross bar automatic exchanging device provided at front and back sides of the press body 1, 3 denotes a die exchanging area defined at the upstream side of the press body 1, and 4 denotes an automatic palletizer provided at the downstream side of the press body 1.

The above-mentioned cross bar automatic exchanging device 2 comprises a cross bar exchanging robot 7 movable on a traveling rail 6 aerially extending in the transverse direction, and a cross bar storage rack 9 storing cross bars 8 to be used in press forming. In the drawings, 10 denotes a moving bolster extracted from the press body 1, on which dies 11 are mounted. At both sides of the die 11, cross bar receptacle bases 12 are extended from the upper surface of the moving bolster 10. On the cross bar receptacle bases 12, the cross bar 8 to be exchanged is mounted by removing it from a transfer bar (not shown).

Figure 3B:
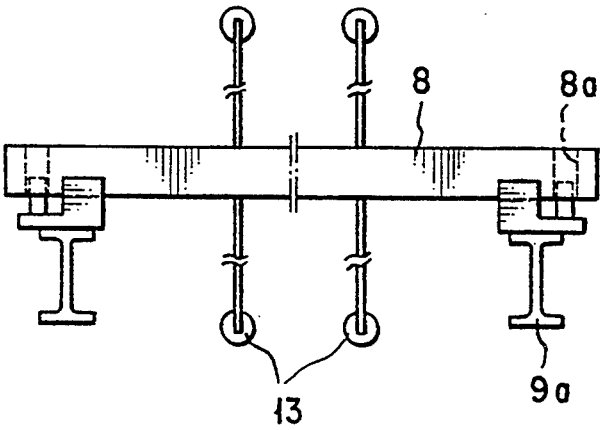
FIG. 3B is a front elevation of a cross bar storage rack.

On the cross bar receptacle bases 12, locating pins **12*a* are extended so that the cross bar 8 is mounted on the pins by engaging pin holes 8*a* extending through both end portions of the cross bar. A vertically orienting workpiece drawing means 13, such as vacuum cups, is mounted on the cross bar 8, as shown in FIGS. 3A and 3B**.

The cross bar exchanging robot 7 has a moving carriage 15 traveling on the traveling rail 6, as shown in FIG. 6. The traveling carriage 15 has rollers 16 which rotate on the traveling rail 6 provided on a transverse beam **15*a*. A traveling motor 17 and a lifting rod 18 are provided at the central portion of the transverse beam 15*a*. Rotation of the traveling motor 17 is reduced by a reduction gear unit 19 and then transmitted to pinions 21 provided at both ends of the transverse beam 15*a* via drive shafts 20. The pinions 21 mesh with racks 23 provided on the platform 22 supporting the traveling rail 6. In response to rotation of the pinions 21, the traveling carriage 15 moves along the traveling rail 6**.

The lifting rod 18 is supported for vertical movement on a support member 25, provided at the central portion of the transverse beam **15*a*, via linear guides 26. A lifting motor 27 is mounted on the support member 25. With this lifting motor 27, a pinion 29 is driven to rotate via a reduction gear unit 28. The pinion 29 is meshed with a rack 30 attached on the lifting rod 18 so as to move up and down the lifting rod 18**.

Figure 8:
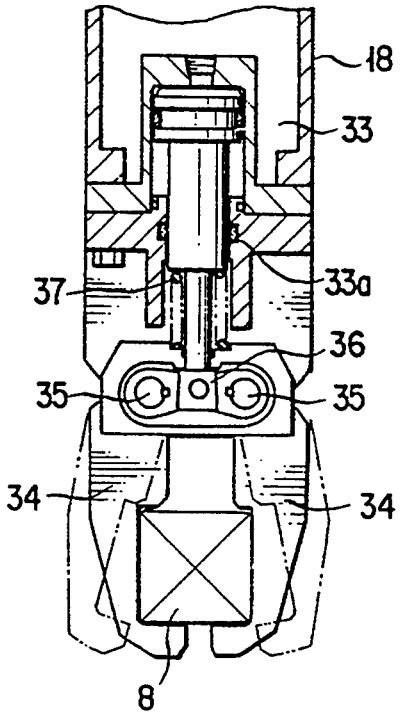
FIG. 8 is a sectional view of the cross bar exchanging device taken along line VIII—VIII of FIG. 7.

A chucking device 32 is mounted on the lower end of the lifting rod 18. The chucking device 32 holds the cross bar 8, stores the cross bar in the cross bar storage rack 9, and mounts the cross bar 8 onto the cross bar receptacle base 12. As shown in FIG. 8, the chucking device 32 has a chucking cylinder 33 provided at the lower end of the lifting rod 18.

The tip end of a piston rod **33*a* extending downwardly from the chucking cylinder 33 is connected to a pin 35 supporting a chucking finger 34, via a link 36. The base portion of the chucking finger 34 is supported at the lower end of the lifting rod 18 at by a pin 35 so that the tip end side is opened according to expansion of the piston rod 38*a*. Closing of respective chucking fingers 34 is performed by a return spring 37 wound around the piston rod 33*a***.

Next, the operation of the above device will be described. The cross bar 8 to be exchanged is already mounted on the cross bar receptacle base 12 of the moving bolster 10, and the bolster is withdrawn frontwardly or rearwardly from the press body 1, together with the die 11, as shown in FIG. 1. When the moving bolster 10 reaches the front side or rear side position of the press body 1, the cross bar exchanging robot 7, previously maintained in stand-by state, moves above the cross bar 8 to be initially removed and lowers the lifting rod 18.

Then, the chucking device 32 at the lower end of the lifting rod 18 chucks the central portion of the cross bar 8, moves up to a storage height of the cross bar storage rack 9, and then moves over top of the cross bar storage rack 9 for storing the cross bar 8 in the storage position **9*a* in the cross bar storage rack 9**.

It should be noted that the storage positions **9*a* are preliminarily given addresses so that the cross bar 8 stored in a given storage position 9*a* is recorded according to the address of the position. By this, upon performing a later press operation for the same model number as performed previously, the necessary cross bar 8 can be accurately and quickly taken out of the storage rack 9 for use. Similarly, an identification number, such as model number, step number and so forth of the formed product is preliminarily provided for each cross bar 8 in the form of a bar code or so forth. By reading the identification number by means of a reading device, such as a bar code reader or so forth provided on the chucking device 32, the bar code of the cross bar 8 to be exchanged can be checked at every occurrence to avoid error in selection of the cross bar 8**.

When all of the used cross bars 8 are stored in the cross bar storage rack 9 by repeating the foregoing operation, the cross bars 8 to be used in the next pressing operation are taken out of the storage positions **9*a* one-by-one according to the addresses and then set on the cross bar receptacle base 12 on the moving bolster 10** by an operation opposite to that set forth above.

The exchanging operation of the cross bar 8 is performed completely and automatically during operation of the press body 1. Once the exchanging operation is completed, a stand-by state is maintained until the press operation is finished.

When the press operation is finished, the used die 11 and the cross bars 8 are taken out of the press body 1 together with the moving bolster 40. Then, another moving bolster 40 held in the stand-by state is moved into the press body 4 for the next press operation. It should be noted that when the period required for exchanging the cross bars becomes longer than a normal production period, a period occurs in which the press is not in operation because it must wait for the completion of the exchanging operation In such case, as shown in FIG. 5, the exchanging period may be shortened to avoid the waiting period after completion of the press operation by employing the automatic exchanging device including two sets of the lifting devices 18 and the chucking device 32.

Figure 9:
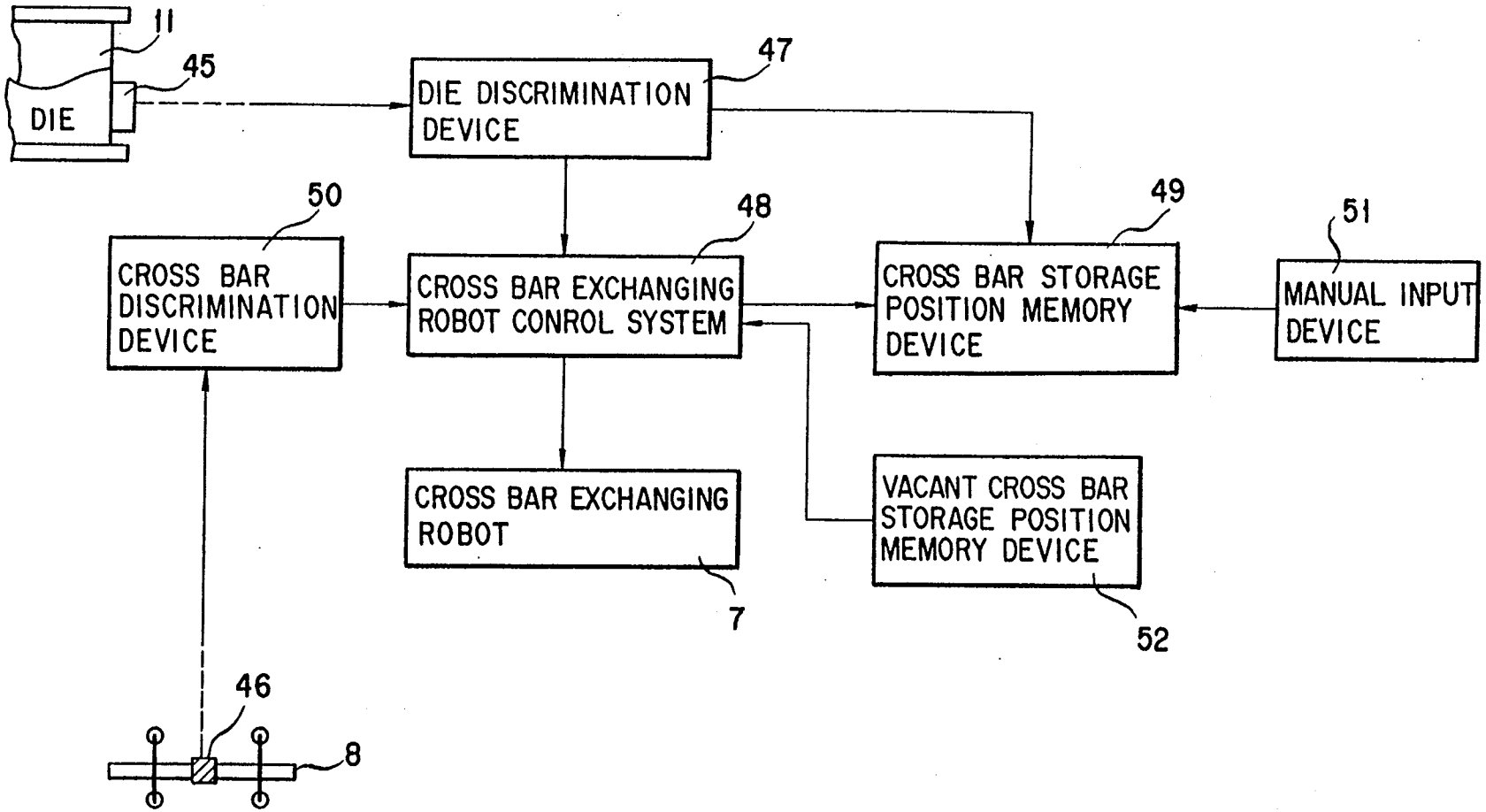
FIG. 9 is a block diagram showing one example of a control system for controlling the cross bar control device of the present invention.

Next, a control system of the foregoing cross bar automatic exchanging device will be discussed in connection with FIG. 9.

A die indication 45 in the form of a bar code or so forth in provided on the die 11 mounted on the moving bolster 10. Similarly, the cross bar 8 is provided with a cross bar identification indication 46.

The die identification indication 45 is read by a die discrimination device 47 of the control system and input to a cross bar exchanging robot control system 48 and a storage rack memory device 49 which stores the address given for the cross bar storage position 9*a*. On the other hand, the cross bar identification indication 46 is read by a cross bar discrimination device 50 and input to the cross bar exchanging robot control system 48.

It should be noted that, in the drawings, the reference numeral 51 denotes an input device for inputting the address manually when the cross bar 8 is manually stored in the cross bar storage rack 9, and 52 denotes a memory device for storing vacant addresses of the storage position 9*a* and constitutes, for example, a sequencer.

Next, the operation of the control system will be discussed. When the die 11 and the cross bar 8 are withdrawn frontwardly and rearwardly from the transfer press via the moving bolster 10 for exchanging the die after finishing the press operation, the die discrimination device 47 reads the die identification indication 45 provided on the die 11 and inputs the die data to the cross bar exchanging robot control system 48. By this, the cross bar exchanging robot control system 48 controls the cross bar exchanging robot 7 which is maintained in stand-by state at the upper side. Initially, the cross bar exchanging robot 7 is moved above the cross bar 8 to be first removed and grips the cross bar 8 on the cross bar receptacle base 12 by the chucking device 32 provided at the lower end of the lifting rod 18.

The cross bar identification indication 48 attached to the cross bar 8 is read by the cross bar discrimination device 50 provided on the chucking device 32 for confirmation that the cross bar 8 is adapted to the die 11. Thereafter, the cross bar exchanging robot control system 48 detects the vacant storage position 9*a* from the memory device 52 storing the vacant position in the storage rack, moves the cross bar exchanging robot 7 through a minimum moving distance, and stores the cross bar 8 in the vacant storage position 9*a*.

After finishing storing of the all cross bar 8 by subsequently repeating the above-mentioned operations, the moving bolster 10 is moved into the transfer press to complete exchanging of the die 11.

On the other hand, once the exchanging of the die 11 is completed and the preceding production die 11 is transferred into the cross bar automatic exchanging device 2, the die discrimination device 47 initially reads the die identification indication 45 provided on the die 11 and inputs the cross bar exchanging robot control system 48.

Once the cross bar exchanging robot control system 48 confirms that the introduced die 11 is consistent with the die to be used for the next pressing operation on the basis of the preliminarily input command, the cross bar storage position 9*a* storing the cross bar 8 adapted to the die 11 is read out from the memory device 49 to move the cross bar exchanging robot 7 through a minimum distance to take out the cross bar 8 stored in the storage position 9*a* to place on the cross bar receptacle base 12 on the moving bolster 10.

Thereafter, by repeating the above-mentioned operations for necessary times to complete transferring of all of the cross bars, the initial position is re-established and held in a stand-by state.

When the press operation is finished and the used die 11 is removed, the die 11 and the cross bar adapted thereto are introduced into the transfer press through the moving bolster 10. Then, the transfer bars are set on respective predetermined positions.

We claim:

1. A cross bar automatic exchanging device for a transfer feeder comprising:

a cross bar exchanging robot for exchanging cross bars removed from a press body via a moving bolster together with a die to be exchanged with cross bars to be used in a future pressing; and a cross bar storage rack for storing a plurality of cross bars.

2. A cross bar automatic exchanging device for a transfer feeder as set forth in claim 1, wherein said cross bar storage rack includes a plurality of storage positions each having a given address, preliminarily designated cross bars being stored in respective storage positions.

3. A cross bar automatic exchanging device for a transfer feeder as set forth in claim 1, wherein an identification mark is provided on each said cross bar, the identification mark being read by means for reading an identification mark during each exchange.

4. A control system for a cross bar automatic exchanging device, in which cross bars removed from a press body via a moving bolster together with a die to be exchanged are stored in a cross bar storage rack by a cross bar exchanging robot, and subsequently cross bars adapted to a die to be used in the next operation are set on said moving bolster by said cross bar exchanging robot, comprising:

a die discrimination device for discriminating a die identification indication provided on each of a plurality of dies and selecting one of the dies to be used in the next operation according to the identification indications;

a cross bar discrimination device for discriminating cross bars adapted to the die to be used in the next operation from a plurality of cross bars according to identification indications provided on the cross bars;

a cross bar exchanging robot control device for controlling the cross bar exchanging robot for removing the discriminated cross bars from the cross bar storage rack; and a memory device for storing storage positions for the cross bars stored in the cross bar storage rack; and a memory device for storing vacant storage positions in the cross bar storage rack.

5. An automatic exchanging system for a cross bar in a transfer feeder comprising:

a cross bar exchanging robot for exchanging cross bars withdrawn from a press body together with a die to be exchanged with cross bars to be used in a future pressing; and a cross bar storage for storing a plurality of cross bars.

6. A control system for a cross bar automatic exchanging device, in which cross bars withdrawn from a press body via a moving bolster together with a die to be exchanged are stored in a cross bar storage by a cross bar exchanging robot, and subsequently cross bars adapted to a die to be used in the next operation are set on said moving bolster by said cross bar exchanging robot, comprising:

die discrimination means for discriminating a die identification provided on each of a plurality of dies and selecting one of the dies to be used in the next operation according to the identification;

cross bar discrimination means for discriminating cross bars adapted to the die to be used in the next operation from a plurality of cross bars according to identification indications provided on the cross bars;

cross bar exchanging robot control means for controlling the cross bar exchanging robot for removing the discriminated cross bars from the cross bar storage;

storage position memory means for storing positions for the cross bars stored in the cross bar storage; and vacant position memory means for storing vacant storage positions in the cross bar storage.

7. A system for exchanging a cross bar in a transfer feeder for exchanging a first cross bar adapted to a first die and a second cross bar adapted to a second die and distinct from said first cross bar, the system comprising:

first means for carrying the first cross bar between a first position where said first cross bar is set in a press body and a second position where said first cross bar is withdrawn out of said press body;

second means for storing said first and second cross bars in one of a plurality of storage spaces;

third means active while said first means is in second position, for removing said first cross bar from said first means, carrying said first cross bar to one of the storage spaces for storing said first cross bar, moving to another storage space where said second cross bar is stored for picking up said second cross bar, carrying said second cross bar to said first means placed at said second position for setting said second cross bar thereon; and fourth means for controlling operation of said third means for automatically exchanging the first cross bar and the second cross bar.

8. A system as set forth in claim 7, wherein said first means also carries first and second dies between said first and second positions.

9. A system as set forth in claim 8, wherein said first and second dies respectively carry die identifications and said first and second cross bars respectively carry cross bar identifications, and said system further comprises fifth means for discriminating said first and second dies on the basis of said die identifications, and sixth means for discriminating said first and second cross bars on the basis of said cross bar identification, said fourth means controlling said third means on the basis of the results of discrimination by said fifth and sixth means.

10. A system as set forth in claim 9, wherein said second means includes a plurality of storage spaces for receiving said cross bar each space having specific locations, and said fourth means controls said third means for storing said first cross bar removed from said first means at a first specific storage space at a first specific location and picking up said second cross bar from a second specific storage space at a second specific location.

11. A system as set forth in claim 10, wherein each of said specific locations of said storage spaces are identified by specific addresses, and a storage condition of each storage space is stored in a data memory accessible according to said specific addresses.

12. A system as set forth in claim 11, wherein said fourth means derives minimum distance paths for carrying said first cross bar from said first means to said first specific location, from said first specific location to said second specific location and from said second specific location to said first means.

13. A cross bar automatic exchanging device of a transfer feeder comprising:

a cross bar storage rack for storing a plurality of cross bars; and a cross bar exchanging robot cooperated with said cross bar storage rack and movable between a press body and said cross bar storage rack for exchanging cross bars removed from the press body via a moving bolster together with a die to be exchanged with cross bars stored in said cross bar storage rack and to be used in a future pressing.

14. A cross bar automatic exchanging device for a transfer feeder as set forth in claim 13, wherein said cross bar storage rack includes a plurality of storage positions each having a given address, preliminarily designated cross bars being stored in respective storage positions.

15. A cross bar automatic exchanging device for a transfer feeder as set forth in claim 13, wherein an identification mark is provided on each said cross bar, the identification mark being read by means for reading an identification mark during each exchange.

16. An automatic exchanging system for a cross bar in a transfer feeder comprising:

a cross bar storage for storing a plurality of cross bars for press processes, each of said cross bars being stored in a known position within said cross bar storage; and a cross bar exchanging robot operable between said cross bar storage and a press body for storing cross bars withdrawn from said press body at a corresponding known position in said cross bar storage and taking out another cross bar to be used for the next press process from a corresponding known position thereof according to a known schedule of press operation.

* * * * *